US011725441B2

(12) United States Patent
Duer et al.

(10) Patent No.: US 11,725,441 B2
(45) Date of Patent: Aug. 15, 2023

(54) GUIDE CARRIAGE FOR MOVABLY MOUNTING A FURNITURE PART

(71) Applicant: Julius Blum GmbH, Hoechst (AT)

(72) Inventors: Stefan Duer, Schwarzach (AT); Matthias Rupp, Hohenweiler (AT)

(73) Assignee: JULIUS BLUM GMBH, Hoechst (AT)

( * ) Notice: Subject to any disclaimer, the term of this patent is extended or adjusted under 35 U.S.C. 154(b) by 200 days.

(21) Appl. No.: 17/317,458

(22) Filed: May 11, 2021

(65) Prior Publication Data

US 2021/0262266 A1 Aug. 26, 2021

Related U.S. Application Data

(63) Continuation of application No. PCT/AT2019/060370, filed on Nov. 5, 2019.

(30) Foreign Application Priority Data

Nov. 13, 2018 (AT) ..... A 50979/2018

(51) Int. Cl.
*E05D 15/00* (2006.01)
*E05D 15/26* (2006.01)
*E05D 15/06* (2006.01)

(52) U.S. Cl.
CPC ..... *E05D 15/264* (2013.01); *E05D 15/063* (2013.01); *E05D 15/0652* (2013.01); *E05Y 2900/20* (2013.01)

(58) Field of Classification Search
CPC ..... E05D 15/00; E05D 15/1005; E05D 15/28; E05D 15/0608; E05D 15/0621;
(Continued)

(56) References Cited

U.S. PATENT DOCUMENTS 1,195,197 A * 8/1916 Frantz ..... E05D 15/063 411/401
1,787,468 A * 1/1931 Bittorf ..... E05D 15/063 16/105

(Continued)

FOREIGN PATENT DOCUMENTS

AT 516282 4/2016
CN 106320906 1/2017

(Continued)

OTHER PUBLICATIONS

International Search Report dated Dec. 20, 2019 in International (PCT) Application No. PCT/AT2019/060370.

(Continued)

*Primary Examiner* — Chuck Y Mah
(74) *Attorney, Agent, or Firm* — Wenderoth, Lind & Ponack, L.L.P.

(57) ABSTRACT

A guide carriage includes a chassis having a rotatably supported running wheel and a connecting member for connecting the guide carriage to the furniture part. The chassis and the connecting member are configured as constructional units separate from one another and are configured to be connected to one another by a fastening device. The fastening device includes a force storage member and at least one locking element configured to be pressurized by the force storage member. The chassis and the connecting member are configured to be releasably locked to one another by a force of the force storage member. A holding device separate from the fastening device is provided for fastening the connecting member to the chassis. The connecting member is configured to be hung into the chassis via the holding device, can be pivoted about a, preferably horizontally extending, axis in the hung-in condition, and can be locked to the chassis by the locking element.

20 Claims, 6 Drawing Sheets

(58) Field of Classification Search

CPC ... E05D 15/0626; E05D 15/264; E05D 15/06; E05D 15/063; E05D 15/0643; E05D 15/0647; E05D 15/165; E05D 15/0652; E05D 15/0653; E05D 15/26; E05D 15/262; E05Y 2201/64; E05Y 2201/688; E05Y 2201/708; E05Y 2201/612; E05Y 2201/614; E05Y 2900/531; E05Y 2900/532; E05Y 2900/20; E05Y 2900/131; E05Y 2900/132; E05Y 2900/142; E06B 3/50; E06B 3/485; E06B 9/36; E06B 3/42; E06B 3/46; E06B 3/4609; E06B 3/4636; B60J 5/06; B60J 5/062; B60J 5/047; B60J 5/12; B60J 5/04; Y10T 16/364; Y10T 16/3813; Y10T 16/3837; Y10T 16/384; Y10T 16/3825; A47H 2023/025; A47H 1/04; A47H 15/00; A47H 15/02; A47H 15/04

See application file for complete search history.

(56) References Cited

U.S. PATENT DOCUMENTS

| | | | | |
|---|---|---|---|---|
| 3,757,384 | A * | 9/1973 | Rusch | E05D 15/264 16/97 |
| 3,793,673 | A | 2/1974 | Lawrence, Jr. | |
| 3,829,929 | A | 8/1974 | Foltz et al. | |
| 4,651,469 | A * | 3/1987 | Ngian | E05D 15/1021 49/411 |
| 5,085,262 | A | 2/1992 | Tutikawa | |
| 6,209,171 | B1 * | 4/2001 | Pelletier | E05D 15/08 403/374.5 |
| 6,983,512 | B2 * | 1/2006 | De Oliveira | E05D 15/063 16/97 |
| 7,117,559 | B1 * | 10/2006 | Barber | E05D 15/063 16/105 |
| 8,984,716 | B2 * | 3/2015 | Proctor | E05D 15/063 16/97 |
| 9,032,589 | B2 * | 5/2015 | Pelekanos | E05D 15/0639 16/98 |
| 9,976,329 | B1 * | 5/2018 | Lucci | E05D 15/0639 |
| 10,400,493 | B2 | 9/2019 | Gabl | |
| 10,604,930 | B2 * | 3/2020 | Downey | E04B 2/827 |
| 11,002,052 | B2 * | 5/2021 | Terno | E05D 15/063 |
| 11,274,482 | B2 | 3/2022 | Rupp et al. | |
| 2009/0289463 | A1 | 11/2009 | Tsai | |
| 2013/0205542 | A1 * | 8/2013 | Backman | E05D 15/0634 16/102 |
| 2017/0260789 | A1 | 9/2017 | Gabl | |
| 2019/0284859 | A1 | 9/2019 | Rupp et al. | |

FOREIGN PATENT DOCUMENTS

| | | | | |
|---|---|---|---|---|
| CN | 108150041 | | 6/2018 | |
| DE | 39 03 700 | | 8/1990 | |
| DE | 93 00 918.6 | | 4/1993 | |
| DE | 196 18 672 | | 1/1997 | |
| EP | 0 610 557 | | 8/1994 | |
| EP | 2390447 | A2 * | 11/2011 | E05D 15/063 |
| EP | 2 894 285 | | 7/2015 | |
| JP | 58-159372 | | 10/1963 | |
| JP | 2004-76431 | | 3/2004 | |
| JP | 2005-30110 | | 2/2005 | |
| JP | 2018-96203 | | 6/2018 | |
| JP | 2018-155002 | | 10/2018 | |
| KP | 20-0385680 | | 5/2005 | |
| TW | 201831770 | | 9/2018 | |
| WO | 2004/040091 | | 5/2004 | |
| WO | WO-2011121243 | A1 * | 10/2011 | A47H 15/02 |
| WO | 2018/129572 | | 7/2018 | |

OTHER PUBLICATIONS

Search Report dated Mar. 16, 2022 in corresponding Chinese Patent Application No. 201980074732.6.

* cited by examiner

GUIDE CARRIAGE FOR MOVABLY MOUNTING A FURNITURE PART

BACKGROUND OF THE INVENTION

The present invention relates to a guide carriage for displaceably supporting a furniture part on a guide rail, the guide carriage comprising a chassis having at least one rotatably supported running wheel and at least one connecting member for connecting the guide carriage to the furniture part. The chassis and the connecting member are configured as constructional units separate from one another and are configured to be connected to one another by at least one fastening device. The fastening device includes at least one force storage member and at least one locking element configured to be pressurized by the force storage member. The chassis and the connecting member are configured to be releasably locked to one another by a force of the force storage member, wherein a holding device separate from the fastening device is provided for fastening the connecting member to the chassis.

Furthermore, the invention concerns a guide system for displaceably supporting a furniture part, the guide system comprising at least one guide rail and at least one guide carriage of the type to be described, the at least one guide carriage being displaceable on the guide rail.

Moreover, the invention relates to an item of furniture comprising a furniture carcass, at least one furniture part movably supported relative to the furniture carcass and a guide system of the type to be described.

Guide carriages are employed for the displaceable support of a furniture part, for example of a door wing, along a guide rail. The guide carriage, in a mounted condition, is connected to the furniture part via a connecting member on the one hand, and is movably supported by the chassis along the guide rail on the other hand.

FIG. 1 of the DE 39 03 700 A1 reference shows a guide carriage for the displaceable support of a folding door along a guide rail. The guide carriage includes a chassis having running wheels and hinges for movably supporting a door wing. The hinges are supported on a base plate which is adjustably arranged on a fastening plate of the chassis. For this purpose, an elongated hole is provided in the fastening plate, and the base plate can be clampingly fixed on a desired position relative to the fastening plate by a fixing screw. However, there is the danger that the fixing screw may inadvertently be loosened, whereby the adjusted position of the hinges can no longer be maintained. If the fixing screw gets lost, this would result in a crash of the door wing connected to the hinges.

EP 2 894 285 A1 and EP 0 610 557 A1 each disclose guide carriages for movably supporting door wings, and each of the guide carriages has a two-part configuration. The guide carriage includes a chassis configured to run along a guide rail and a separate connecting member for connecting the door wing. The chassis and the connecting member can be releasably locked to one another by a widened head portion, and a locking lever pressurized by a spring is provided for locking the head portion. A drawback is the fact that the mounting operation of the door wing to the chassis, in particular with heavy door wings, is considerably impeded. More precisely, for mounting the door wing, the head portion must namely be accurately fitted into an insertion opening of the locking device. Moreover, the door wing, in a connected condition between the chassis and the connecting member, is pivotable about a horizontally extending axis formed by the guide carriage. This has the drawback that the door wing, in a region close to the ground, can be lifted from the furniture carcass to a relatively far extent. This can lead to an undefined movement behavior of the door wing, to undesired tilting movements of the components of the guide carriage, and to an undue mechanical stress of the guide carriage and other components of the item of furniture.

SUMMARY OF THE INVENTION

It is an object of the present invention to propose a guide carriage of the type mentioned in the introductory part, thereby avoiding the above-discussed drawbacks.

According to the invention, the connecting member is configured to be hung into the chassis via the holding device, can be pivoted about a, preferably horizontally extending, axis in the hung-in condition, and can be locked to the chassis by the at least one locking element.

By virtue of a holding device separate from the fastening device, a very tilting-proof arrangement of the connecting member on the chassis can be afforded.

Thereby, the holding device and the fastening device, in a mounted condition, can be spaced from one another in a height direction. In a first mounting step, the connecting member can be hung into the chassis via the holding device. Subsequently, the hung-in connecting member can be pivoted about an axis and can finally be locked to the chassis by the at least one locking element.

The fastening device includes at least one locking element pressurized by a force storage member for establishing the connection between the chassis and the connecting member. Therefore, the connection between the chassis and the connecting member can be secured by a force of the force storage member. The locking between the chassis and the connecting member can be released by applying a force to the locking element so as to move the locking element against a force of the force storage member.

The locking element can include at least one recess configured to be engaged with a coupling element arranged on the chassis or on the connecting member. Thereby, the coupling element can be configured substantially cylindrical. For example, the coupling element can be configured as a, preferably cylindrical, pin or as a, preferably cylindrical, rod. Accordingly, the locking element, in a locking position, is locked with the coupling element in a form-locking manner, so that the locking element and the coupling element adopt a defined end position relative to one another in the locking position.

According to an embodiment, the at least one locking element is pivotally supported about an axis. It is preferable that the axis extends horizontally in a mounted condition.

Alternatively, the locking element is, preferably linearly, displaceably supported and is pre-stressed by a force of the force storage member in a direction of a locking position.

The force storage member for pressurizing the locking element can include, for example, a mechanical spring element, such as, for example, a helical spring, a leg spring or a spiral spring. Alternatively, the force storage member can also be formed by an intrinsic elasticity of the locking element.

BRIEF DESCRIPTION OF THE DRAWINGS

Further details and advantages of the invention result from the following description of figures.

DETAILED DESCRIPTION OF THE INVENTION

Figure 1A:
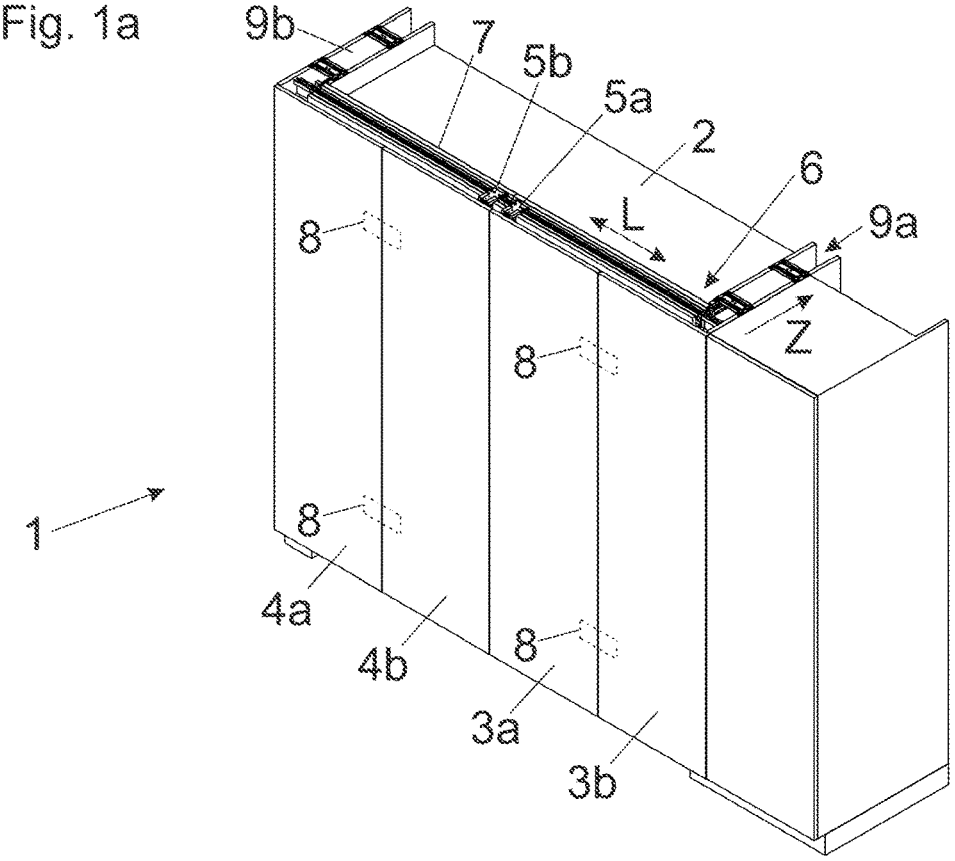
FIG. 1*a*, 1*b* are perspective views of an item of furniture comprising a furniture carcass and furniture parts movably-supported relative to the furniture carcass in two different positions.

FIG. 1*a* shows an item of furniture 1 comprising a furniture carcass 2 and furniture parts 3*a*, 3*b* and 4*a*, 4*b* which are each movably supported relative to the furniture carcass 2. The furniture parts 3*a*, 3*b* are hingedly connected to one another by two or more furniture hinges 8, the furniture hinges 8 being spaced from one another in a height direction and being fixed to a rear side of the furniture parts 3*a*, 3*b*. The two other furniture parts 4*a*, 4*b* are also pivotally connected to one another by two or more furniture hinges 8 which are spaced from one another the height direction. In the shown figure, the furniture parts 3*a*, 3*b* and 4*a*, 4*b* are located in a first position in which the furniture parts 3*a*, 3*b* and 4*a*, 4*b* are aligned substantially coplanar to one another. The furniture parts 3*a*, 3*b* and 4*a*, 4*b* are movable relative to the furniture carcass 2 by a guide system 6, the guide system 6 including at least one guide rail 7 and at least one guide carriage 5*a*, 5*b*. The guide carriages 5*a*, 5*b* are each displaceably supported in a longitudinal direction (L) of the guide rail 7. In a mounted condition, the guide rail 7 is arranged substantially parallel to a front edge of the furniture carcass 2. The first guide carriage 5*a* is hingedly connected to the furniture part 3*a*, whereas the second guide carriage 5*b* is pivotally connected to the furniture part 4*b*.

Figure 1B:
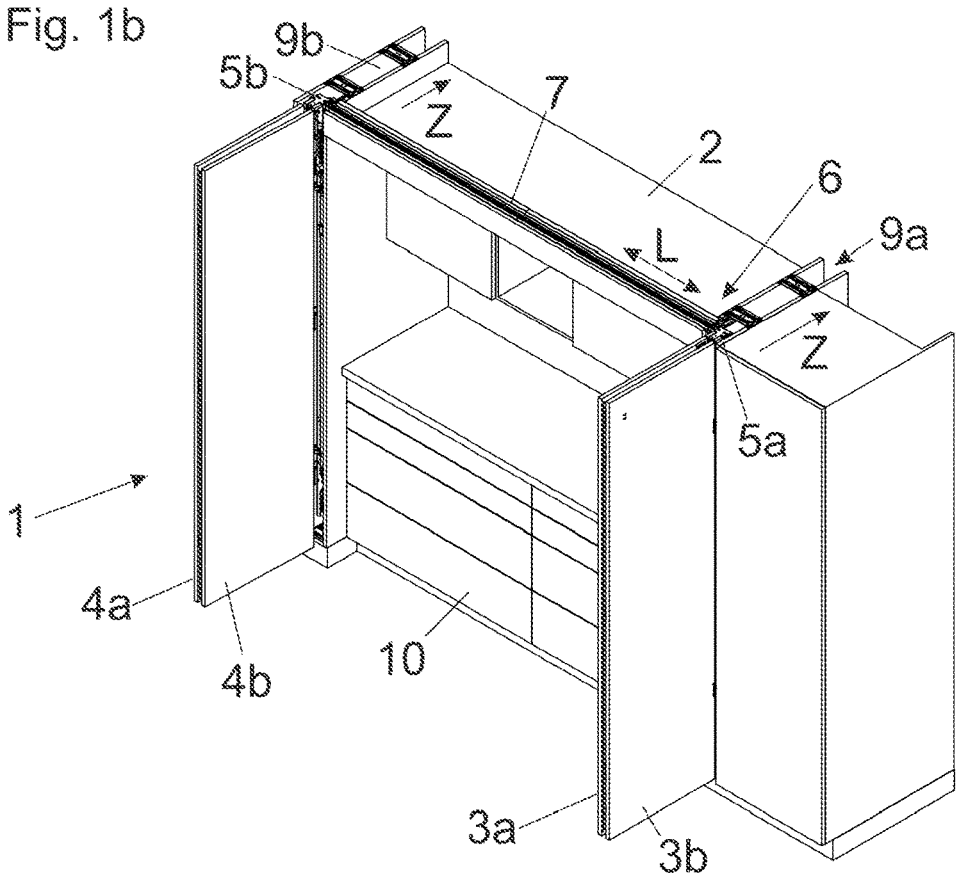

FIG. 1*b* shows the item of furniture 1 according to FIG. 1*a*. The furniture parts 3*a*, 3*b* and 4*a*, 4*b* are located in a second position in which the furniture parts 3*a*, 3*b* and 4*a*, 4*b* are aligned substantially parallel to one another. The furniture parts 3*a*, 3*b*, in a parallel position to one another, can be inserted—jointly with the first guide carriage 5*a*—in a depth direction (Z) into a first lateral insertion compartment 9*a*. The other furniture parts 4*a*, 4*b*, in a parallel position to one another, can be inserted—jointly with the second guide carriage 5*b*—in a depth direction (Z) into a second lateral insertion compartment 9*b*. A direct comparison between FIG. 1*a* and FIG. 1*b* shows that in the first position, in which the furniture parts 3*a*, 3*b* and 4*a*, 4*b* are aligned substantially coplanar to one another (FIG. 1*a*), an inner carcass 10 can be entirely separated from the remaining area of a room. In the second position, in which the furniture parts 3*a*, 3*b* and 4*a*, 4*b* are aligned substantially parallel to one another, the inner carcass 10 is freely accessible for a person. For example, the inner carcass 10 can be in the form of a kitchen block, an office niche, a storage room, a shelf or a walk-in closet.

Figure 2A:
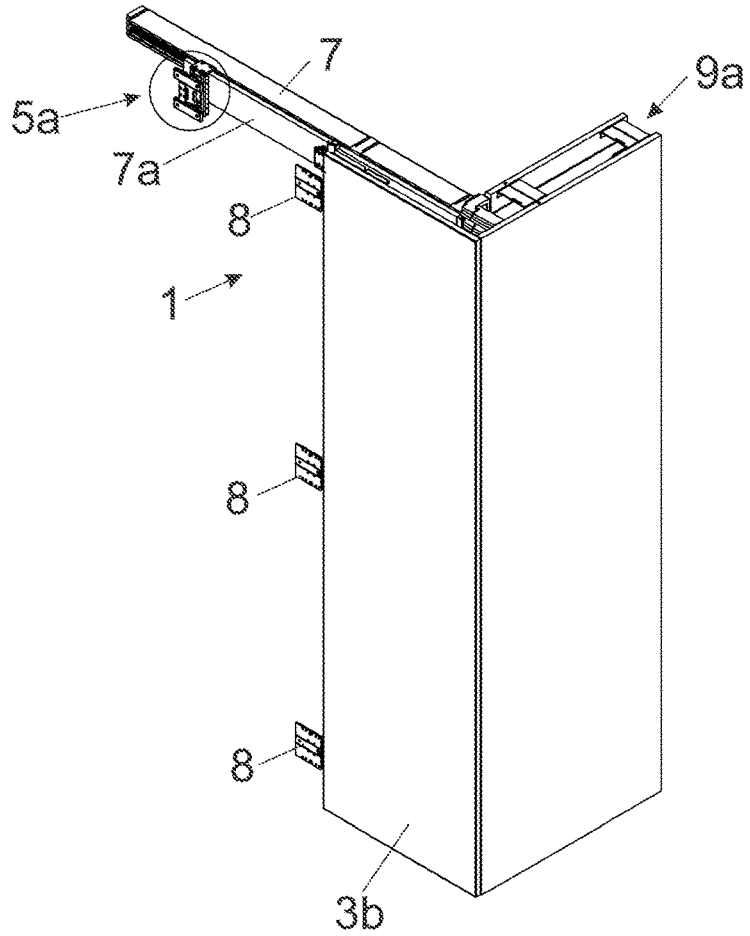
FIG. 2*a*, 2*b* show a partial region of the item of furniture and an enlarged detail view of the guide carriage configured to be displaceable on a guide rail.

FIG. 2*a* shows a partial region of the item of furniture 1, and the furniture part 3*a* is hidden for the sake of improved overview. In a mounted condition, the guide rail 7 is arranged on an upper side of the furniture carcass 2 and extends substantially parallel to a front edge of the furniture carcass 2. The guide carriage 5*a* configured to be hingedly connected to the furniture part 3*a* is displaceable along a guide limb 7*a* of the guide rail 7. The guide limb 7*a*, jointly with the guide rail 7, can have an integral one-piece configuration. Alternatively, the guide limb 7*a* can be formed as a component separate from the guide rail 7.

Figure 2B:
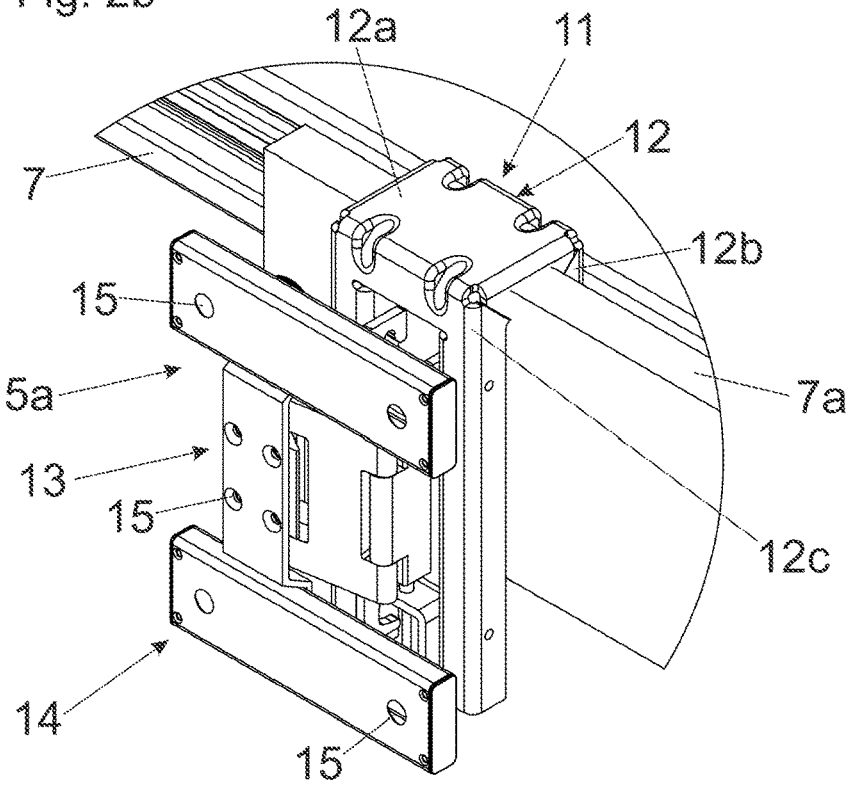
Figure 3:
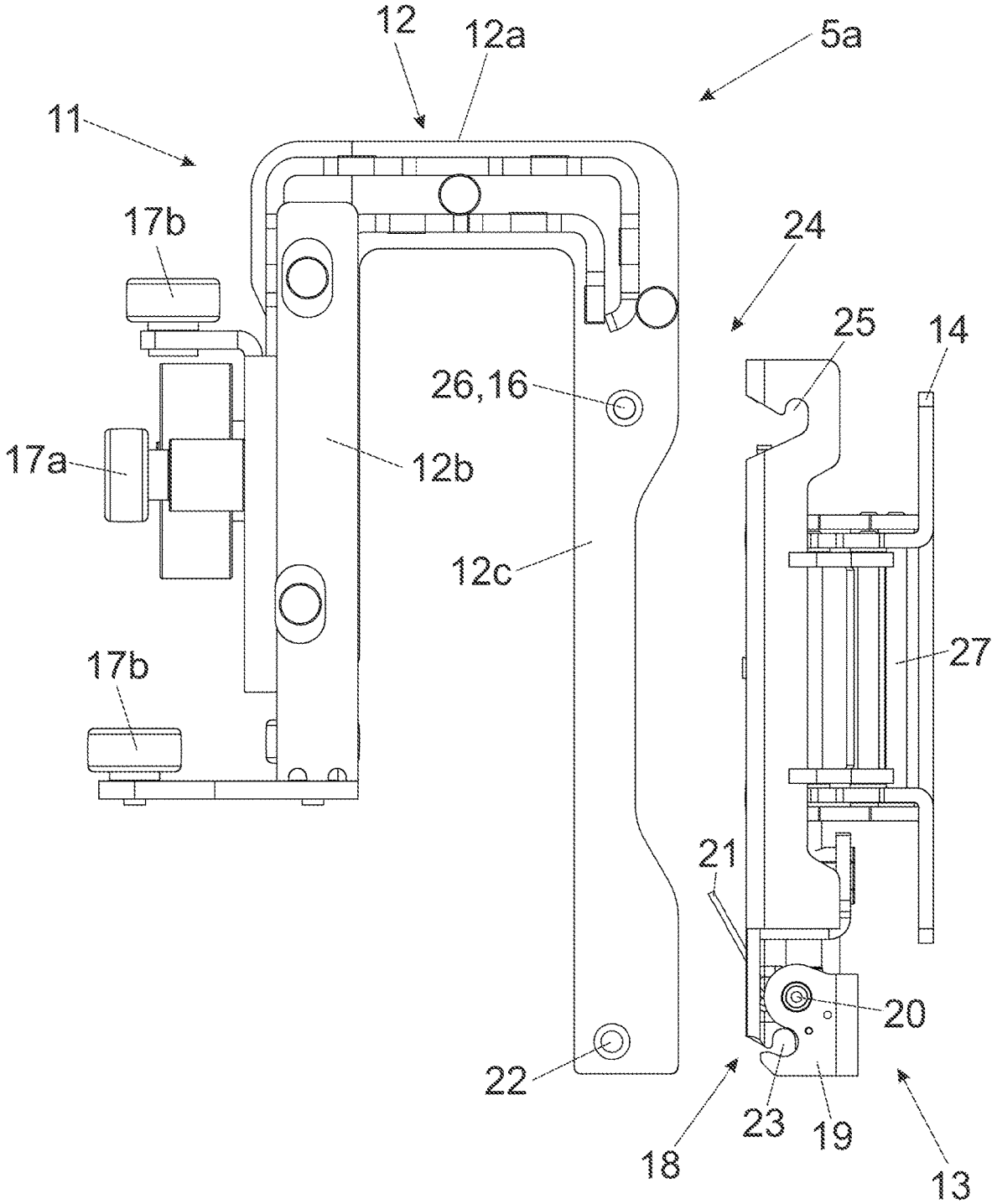
FIG. 3 shows the guide carriage in a cross-sectional view.

FIG. 2*b* shows the encircled region of FIG. 2*a* in an enlarged view in which the construction of the guide carriage 5*a* can be seen in more detail. The guide carriage 5*a* includes a chassis 11 having at least one rotatable running wheel 17*a*, 17*b* (not shown here, see FIG. 3), the at least one rotatable running wheel 17*a*, 17*b* being configured to roll along the guide rail 7. The guide carriage 5*a* further includes a connecting member 13 configured to be connected to the furniture part 3*a*. The chassis 11 and the connecting member 13 are configured as separate constructional units configured to be releasably connected to one another by at least one fastening device 18 (FIG. 3). The connecting member 13 includes a fitting portion 14 configured to be fixed to the furniture part 3*a*, and the fitting portion 14 is pivotally supported about a vertically extending axis 27 (FIG. 3) in a mounted condition. The fitting portion 14 can include at least one or a plurality of fastening locations 15, for example in the form of holes, for fixing the furniture part 3*a*. The chassis 11 includes a portion 12 configured to be U-shaped in a cross-sectional view, the portion 12 at least partially embracing the guide limb 7*a* of the guide rail 7 in a mounted condition. The U-shaped portion 12 includes a base limb 12*a* and two limbs 12*b*, 12*c* protruding from the base limb 12*a* in a downward direction. The at least one rotatably supported running wheel 17*a*, 17*b* is supported on a first limb 12*b* and the connecting member 13 is configured to be arranged on a second limb 12*c* of the U-shaped portion 12 in a mounted condition.

According to a preferred embodiment and for the sake of a comfortable mounting, it can be provided that:

- in a first mounting step, the chassis 11—independently and separately from the connecting member 13—is mounted to the guide rail 7,
- in a second mounting step, the connecting member 13—independently and separately from the chassis 11—is mounted to the furniture part 3*a*, and
- in a third mounting step, the furniture part 3*a*, via the connecting member 13 fixed thereon, is connected to the chassis 11 mounted to the guide rail 7 via the at least one fastening device 18.

FIG. 3 shows the guide carriage 5*a* in a cross-sectional view. The chassis 11 includes at least one running wheel 17*a*, 17*b* configured to run along the guide rail 7. In the shown embodiment, two or more running wheels 17*a*, 17*b* are provided, the running wheels 17*a*, 17*b* being spaced from one another in a height direction. A first running wheel 17*a* has a substantially horizontally extending rotational axis in a mounted condition, whereas a second running wheel 17*b* is configured to be rotated about a substantially vertically extending rotational axis in a mounted condition. The running wheels 17*a*, 17*b* are supported on the first limb 12*b* of the U-shaped portion 12, whereas the connecting member 13 for fixing the furniture part 3*a* is to be mounted to the second limb 12*c* of the U-shaped portion 12. The connecting member 13 includes a fitting portion 14 comprising the fastening locations 15 (FIG. 2*b*) for fixing the furniture part 3*a*, the fitting portion 14 being pivotable about a vertically extending axis 27.

The connecting member 13 is configured to be mounted to the chassis 11 via the at least one fastening device 18. The fastening device 18 includes at least one movably-supported locking element 19 which is pre-stressed by a force storage member 21 (for example in the form of a helical spring, a leg spring or a spiral spring) in a direction of a locking position.

The locking element 19 is configured to be releasably locked to a coupling element 22 arranged on the chassis 11. The locking element 19 is provided with at least one recess 23 configured to be engaged with the coupling element 22 arranged on the chassis 11. In the shown embodiment, the locking element 19 is pivotally supported about an axis 20 extending in a horizontal direction in a mounted condition.

According to the invention, a holding device 24 separate from the fastening device 18 is provided, the holding device 24 being provided for fixing the connecting member 13 to the chassis 11. The holding device 24 and the fastening device 18 are spaced from one another in a height direction in a mounted condition. The holding device 24 includes at least one notch 25 arranged on the connecting member 13, the at least one notch 25 being provided for engaging the connecting member 13 on the carrier 11. At least one holding element 26 is formed or arranged on the chassis 11, the at least one holding element 26 engaging in the notch 25 in a connected condition of the connecting member 13. In a first mounting step, the connecting member 13 can be hung into the chassis 11 via the holding device 24. Subsequently, the connecting member 13 hung into the chassis 11 is pivoted about an axis 16 which is preferably formed by the holding element 26. Finally, the connecting member 13 can be releasably locked to the chassis 11 by the at least one locking element 19.

Figure 4:
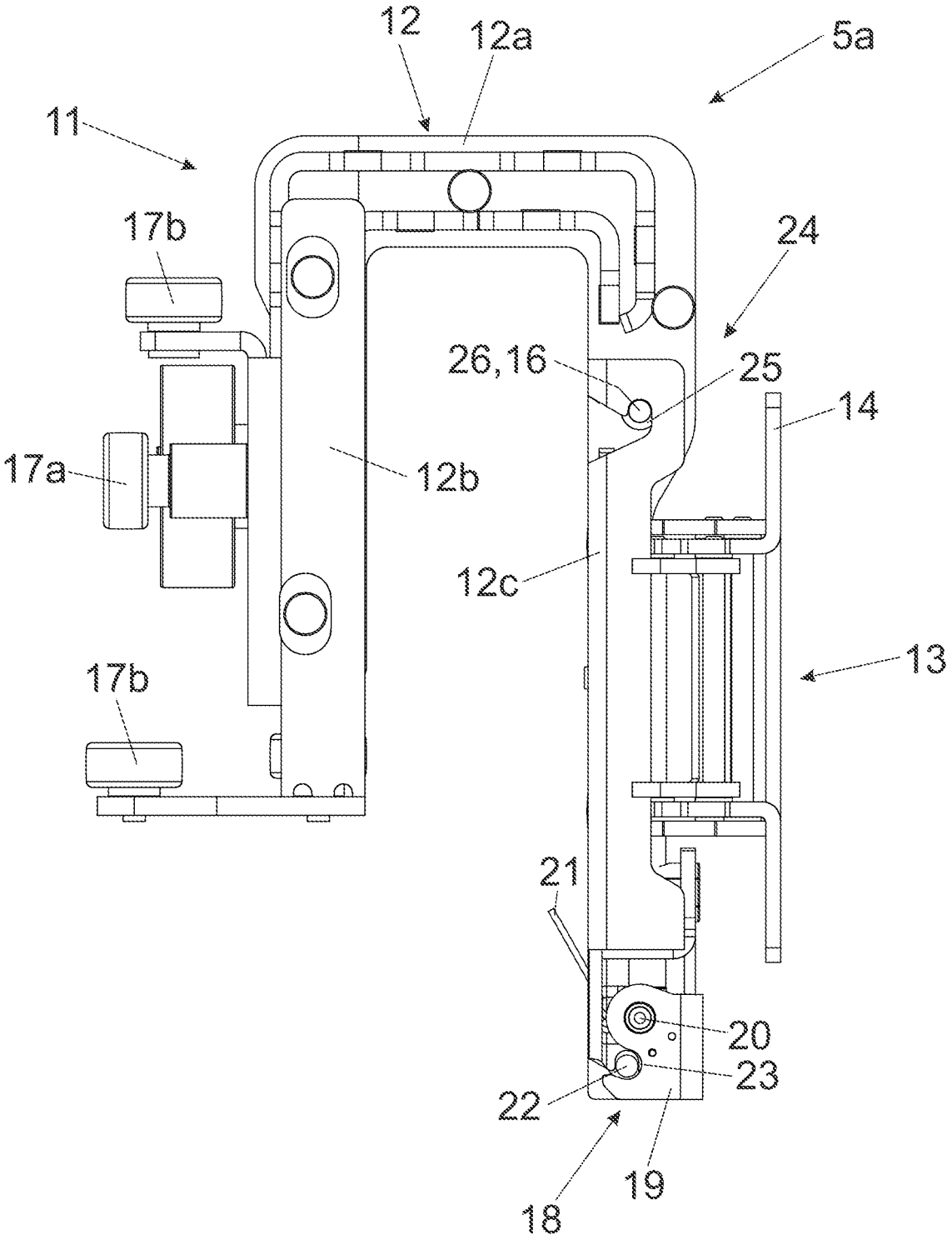
FIG. 4 shows the locked condition of the connecting member on the chassis in a cross-sectional view.

FIG. 4 shows the locked condition of the connecting member 13 on the chassis 11 in a cross-sectional view. By hanging the notch 25 of the holding device 24 on the holding element 26, the connecting member 13 can be pivoted relative to the chassis 11 about a horizontally extending axis 16. By virtue of the fastening device 18 having the locking element 19, a form-locking connection between the connecting member 13 and the chassis 11 can be established. When the locking element 19 co-operates with the coupling element 22, the locking element 19 is initially moved against a force of the force storage member 21. Subsequently, the locking element 19 is configured to be automatically locked by a force of the relaxing force storage member 21. In a locked condition, the connection between the connecting member 13 and the chassis 11 can be released by applying a force to the locking element 19 against a force of the force storage member 21. The locking element 19, in a locked condition, is freely and directly accessible for a person in order to be manually actuated or to be actuated with the aid of a tool.

In the shown embodiment, the locking element 19 of the fastening device 18 and the notch 25 of the holding device 24 are arranged or formed on the connecting member 13. In a kinematic reversal, it is also possible that the locking element 19 of the fastening device 18 and the notch 25 of the holding device 24 are arranged on the chassis 11. In that case, the coupling element 22 and the holding element 26 would have to be arranged on the connecting member 13.

Figure 5:
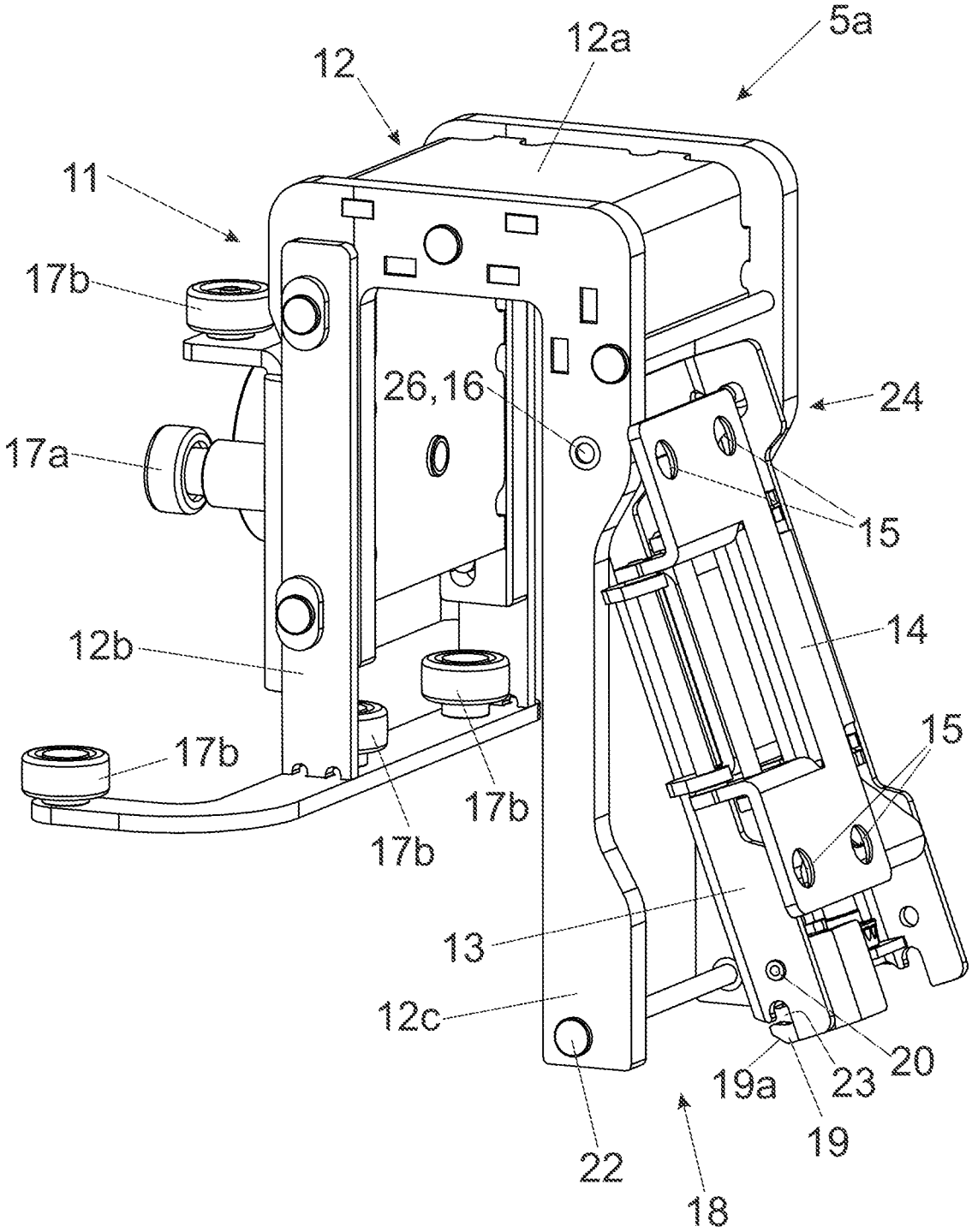
FIG. 5 shows the guide carriage with the chassis and the connecting member configured to be fixed to the chassis in a perspective view.

FIG. 5 shows a perspective view of the guide carriage 5*a* with the chassis 11 and the connecting member 13 configured to be fixed thereon. The chassis 11 can include a plurality of running wheels 17*a* having a horizontal rotational axis and a plurality of running wheels 17*b* having a vertical rotational axis. In the shown figure, the connecting member 13 is pre-positioned on the chassis 11 by the holding device 24, and the holding element 26 of the holding device 24 engages into the notch 25 (FIG. 3) of the connecting member 13. Starting from the position shown in FIG. 5, the connecting member 13 can be pivoted about a horizontally extending axis 16 formed by the holding element 26. Subsequently, an automatic locking can be afforded with the coupling element 22 of the chassis 11 by the locking element 19 which is pre-stressed by the force storage member 21. The coupling element 22 of the fastening device 18 and/or the holding element 26 of the holding device 24 can be in the form of a cylindrical pin or a cylindrical rod. The locking element 19 can be provided with an inclined surface 19*a* for moving the locking element 19, upon the co-operation with the coupling element 22, in a first pivoting direction against a force of the force storage member 21, so that the force storage member 21 can be loaded. When the coupling element 22 enters the recess 23 of the locking element 19, the locking element 19 is moved by a force of the loaded energy storage member 21 in a second pivoting direction, opposite the first pivoting direction, and the locking element 19 can be locked with the coupling element 22 in a form-locking manner.

Figure 6:
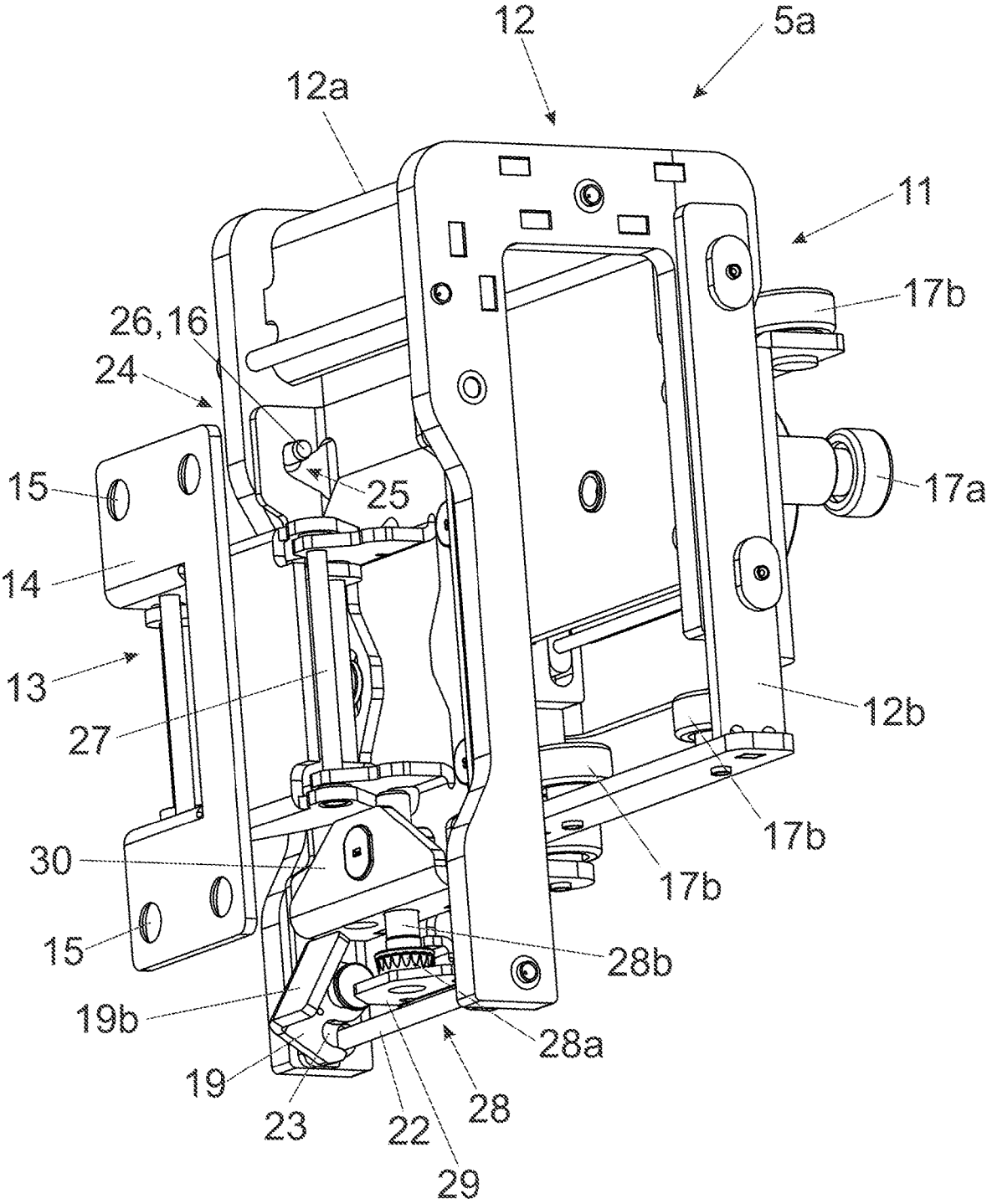
FIG. 6 shows the guide carriage in a further perspective view.

FIG. 6 shows the guide carriage 5*a* in a further perspective view. The connecting member 13 is pre-positioned via the holding device 24 (holding element 26 engaging in notch 25) in a predetermined height position relative to the chassis 11. By the locking element 19, the connecting member 13 can be releasably locked to the chassis 11. The locking element 19 can include an actuating section 19*b*, and the locking can be released by a manual or by a tool-assisted actuation of the actuating section 19*b*.

The guide carriage 5*a* further includes at least one adjustment device 28 having a movably-supported adjustment element 28*a*. By an actuation of the adjustment element 28*a*, a position of the connecting member 13 relative to the chassis 11 can be adjusted in a locked condition between the connecting member 13 and the chassis 11. It can be seen that the fitting portion 14 of the connecting member 13 is pivotally supported relative to a bearing portion 30 about a vertically extending axis 27. The adjustment device 28 includes at least one movably-supported adjustment element 28*a*, and a position of the fitting portion 14 relative to the chassis 11 can be adjusted by an actuation of the adjustment element 28*a*. In the shown embodiment, the adjustment device 28 is configured so as to adjust a height position of the fitting portion 14. The adjustment element 28*a* is rotationally, but non-displaceably, supported on a supporting member 29. The supporting member 29 is supported on the coupling element 22, and a threaded portion 28*b* of the adjustment element 28*a* is in a threading engagement with the bearing portion 30. By rotating the adjustment element 28*a* with the aid of a tool, a height position of the bearing portion 30 and, therefore, a height position of the fitting portion 14 can be adjusted, so that a height position of the furniture part 3*a* connected to the fitting portion 14 can also be adjusted in a mounted condition. Of course, further adjustment devices 28 may be provided for adjusting the fitting portion 14 in a lateral direction and/or in a depth direction relative to the chassis 11.

The invention claimed is:

1. A guide carriage for displaceably supporting a furniture part on at least one guide rail, the guide carriage comprising:

a chassis having a rotatably supported running wheel;

a connecting member for connecting the guide carriage to the furniture part, wherein the chassis and the connecting member are configured as constructional units separate from one another;

a fastening device configured to connect the chassis and the connecting member to one another, wherein the fastening device includes a force storage member and a locking element configured to be pressurized by the force storage member, wherein the chassis and the connecting member are configured to be releasably locked to one another by a force of the force storage member; and a holding device separate from the fastening device and configured to fasten the connecting member to the chassis, wherein the connecting member is configured to be hung onto the chassis via the holding device, is pivotable about an axis when hung on the chassis, and is lockable to the chassis by the locking element.

2. The guide carriage according to claim 1, wherein the locking element includes a recess configured to be engaged with a coupling element arranged on the chassis or on the connecting member.

3. The guide carriage according to claim 2, wherein the coupling element is substantially cylindrical.

4. The guide carriage according to claim 1, wherein the locking element is pivotally supported about an axis.

5. The guide carriage according to claim 4, wherein the axis about which the locking element is pivotally supported extends horizontally in a mounted condition.

6. The guide carriage according to claim 1, wherein the holding device and the fastening device, in a mounted condition, are spaced from one another in a height direction.

7. The guide carriage according to claim 1, wherein the holding device includes a notch for engaging the connecting member on the chassis, the notch being arranged on the connecting member or on the chassis.

8. The guide carriage according to claim 1, wherein the connecting member includes a movably-supported fitting portion configured to be fixed to a furniture part.

9. The guide carriage according to claim 8, wherein the fitting portion is pivotally supported about an axis.

10. The guide carriage according to claim 9, wherein the axis about which the fitting portion is pivotally supported extends vertically in a mounted condition.

11. The guide carriage according to claim 8, wherein the fitting portion includes a fastening location for fixing to a furniture part.

12. The guide carriage according to claim 1, wherein the force storage member includes a mechanical spring element.

13. The guide carriage according to claim 12, wherein the mechanical spring element is a helical spring, a leg spring, or a spiral spring.

14. The guide carriage according to claim 1, wherein the chassis, in a cross-section, includes a substantially U-shaped portion having a base limb and two limbs protruding from the base limb, wherein a rotatably supported running wheel is configured to be arranged on a first limb of the base limb and the two limbs, and the connecting member is configured to be arranged on a second limb of the base limb and the two limbs of the U-shaped portion in a mounted condition.

15. The guide carriage according to claim 14, wherein the substantially U-shaped portion, in a mounted condition of the guide carriage on the guide rail, at least partially embraces a guide limb of the guide rail.

16. The guide carriage according to claim 1, wherein the rotatably supported running wheel of the chassis is a first running wheel of at least two running wheels, wherein the first running wheel of the at least two running wheels, in a mounted condition, has a substantially horizontally extending rotational axis, and a second running wheel of the at least two running wheels, in a mounted condition, has a substantially vertically extending rotational axis.

17. The guide carriage according to claim 1, wherein the guide carriage includes an adjustment device having a movably-supported adjustment element, wherein a position of the connecting member relative to the chassis is adjustable by an actuation of the adjustment element in a locked condition between the connecting member and the chassis.

18. A guide system for displaceably supporting a furniture part, the guide system including a guide rail and the guide carriage according to claim 1, and the guide carriage is configured to be supported along the guide rail.

19. An item of furniture comprising a furniture carcass, a furniture part movably supported relative to the furniture carcass, and the guide system according to claim 18 for moving the furniture part relative to the furniture carcass.

20. The guide carriage according to claim 1, wherein the axis about which the connecting member is pivotable extends horizontally.

* * * * *